US005328070A

United States Patent [19]

Lavi

[11] Patent Number: 5,328,070

[45] Date of Patent: Jul. 12, 1994

[54] ARTICLE SUPPORTING DEVICE FOR USE AS BODY-SUPPORTED TRAY ASSEMBLY

[76] Inventor: Dan Lavi, 3/21 Eilat St., 47280, Ramat Hasharon, Israel

[21] Appl. No.: 721,071

[22] Filed: Jun. 26, 1991

[51] Int. Cl.[5] ..... A45F 5/00

[52] U.S. Cl. ..... 224/270; 224/224; 108/43

[58] Field of Search ..... 224/270, 267, 222, 264, 224/224, 225, 265, 266, 201; 108/43

[56] References Cited

U.S. PATENT DOCUMENTS

| | | | |
|---|---|---|---|
| 1,109,161 | 9/1914 | Chindgren | 224/225 |
| 1,132,813 | 3/1915 | Weller | 224/222 |
| 2,289,945 | 7/1942 | Wadsack | 108/43 |
| 2,685,757 | 8/1954 | Mirigian | 224/270 |
| 2,801,854 | 11/1958 | Best | 224/270 |
| 2,926,826 | 3/1960 | Conrad | 224/201 |
| 3,106,036 | 10/1963 | Harkey | 224/247 |
| 4,402,441 | 9/1983 | Jones et al. | 224/270 |
| 4,715,293 | 12/1987 | Cobbs | 108/43 |

*Primary Examiner*—Linda J. Sholl

*Attorney, Agent, or Firm*—Benjamin J. Barish

[57] ABSTRACT

An article supporting device includes a tray for receiving articles to be supported by the device, an arm having one end secured to one side of the tray and extending longitudinally of the tray at the one side thereof; and a crossbar connected at one end to the opposite end of the arm. The crossbar extends substantially perpendicularly to the arm across the width of the tray with the opposite end of the crossbar spaced from the opposite side of the tray to define a space for the application of the device to the body of a person, thereby enabling the person to support the tray by the person's body alone and without the use of the person's hands.

11 Claims, 1 Drawing Sheet

ARTICLE SUPPORTING DEVICE FOR USE AS BODY-SUPPORTED TRAY ASSEMBLY

FIELD AND BACKGROUND OF THE INVENTION

The present invention relates to article supporting devices, and particularly to such devices for use as a body-supported tray.

Situations frequently arise wherein a person is required to carry articles on a tray but cannot hold the tray by the person's hands. One such situation is a person requiring crutches for moving around, the person's hands being engaged in gripping the crutches and therefore unavailable for holding a tray.

OBJECTS AND BRIEF SUMMARY OF THE INVENTION

An object of the present invention is to provide an article supporting device enabling a person to support various articles on a tray such as to free the person's hands for other uses.

According to the present invention, there is provided an article supporting device including a tray having mounting means for mounting the tray on the body of a person with a side of the tray engageable with the front side of the person's body at about the waistline; characterized in that the mounting means comprises: a crossbar having one end secured to the tray and the opposite end spaced from the tray to permit the device to be applied from the side to the person's body; the crossbar being located to engage the lower part of the person's back when the device is mounted on the person's body.

According to further features in the preferred embodiment of the invention described below, one end of the crossbar is secured to the tray by an arm having a first section adjacent the tray and extending below the tray, and a second section adjacent the crossbar and extending above the first section.

An article supporting device constructed in accordance with the foregoing featues enables a person to conveniently support the tray soley by the person's body thereby freeing the person's hands for other use. In addition, such a construction enables the person to apply the device easily with one hand from the side, and produces substantially no interference with the movements of the hands and shoulder of the person.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
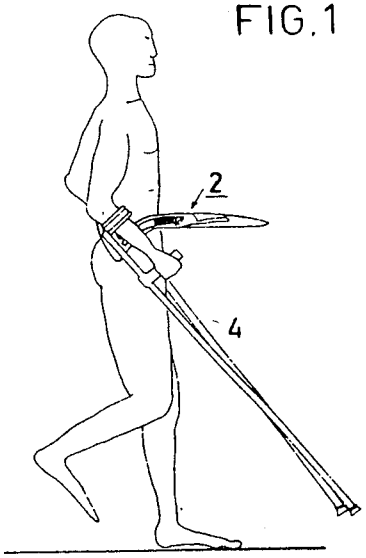
FIG. 1 illustrates one form of article supporting device constructed in accordance with the present invention as supported by the person's body, thereby freeing the person's hands for other use.

FIG. 1 illustrates the article supporting device, generally designated 2, supported by a person who has an injured leg or is otherwise required to use crutches 4 in order to move about. The article supporting device 2 is of a construction, as will be described more particularly below, enabling the device to be conveniently applied to and removed from the person's body and to be supported solely by the person's body, thereby freeing the person's hands for gripping the crutches 4.

Figure 2:
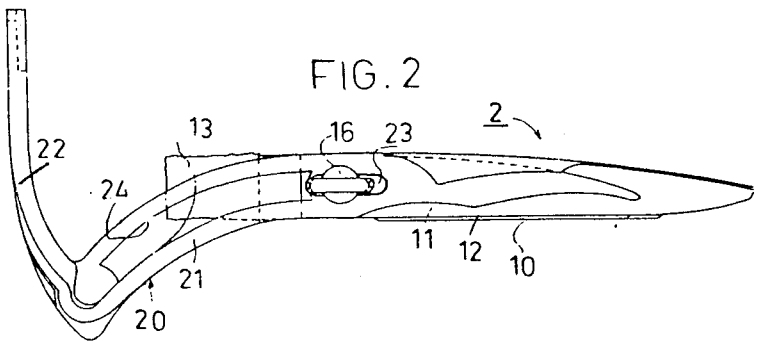
FIG. 2 is an enlarged side elevational view of the article supporting device of FIG. 1.
Figure 4:
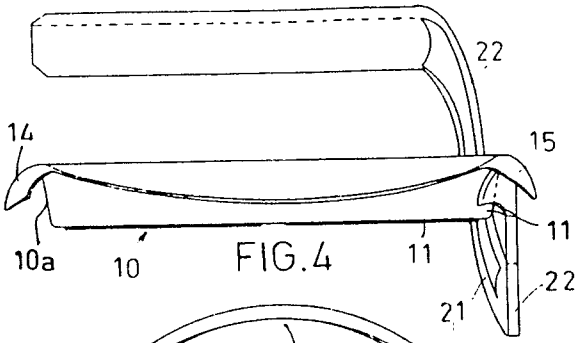
FIG. 4 is an end elevational view of the article supporting device of FIG. 1.
Figure 3:
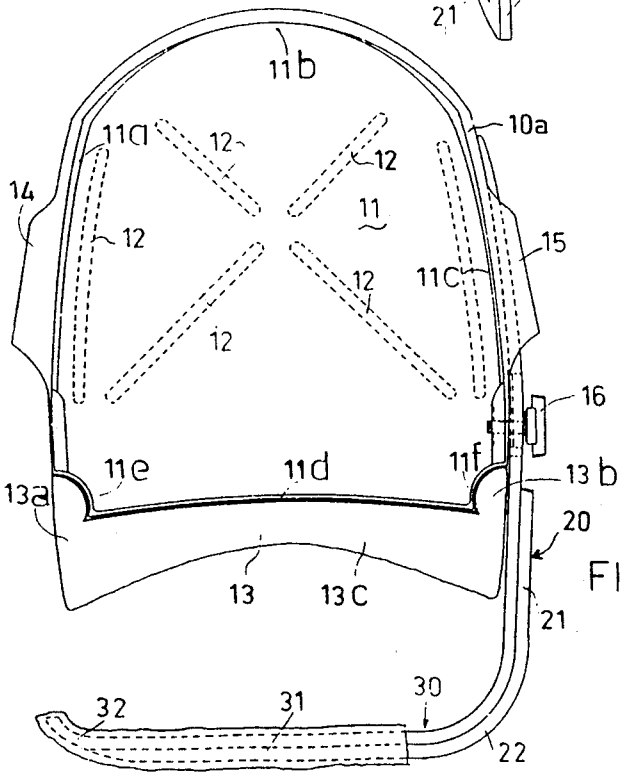
FIG. 3 is a top plan view of the article supporting device of FIG. 1.

The article supporting device 2 illustrated in FIG. 1 is more particularly shown in FIGS. 2–4. It comprises three main components, namely: a tray, generally designated 10, for receiving articles to be supported by the device; a supporting arm, generally designated 20, secured to one side of the tray and extending longitudinally of the tray at that side; and a crossbar, generally designated 30, extending substantially perpendicularly to arm 20 across the width of the tray with the opposite end of the crossbar spaced from the opposite side of the tray to define a space, generally designated SP, for the application of the device to the body of the person.

More particularly, the tray 10 includes a flat bottom wall 11 for receiving the articles to be supported by it. Bottom wall 11 is of generally rectangular configuration but with smoothly curved sides 11*a*, 11*b*, 11*c*. The fourth side 11*d* of the bottom wall 11 facing the person supporting the device is straight. The bottom wall 11 is preferably reinforced by ribs 12 at its underface.

The three sides 11*a*, 11*b*, 11*c* of the bottom wall 11 are circumscribed by an upstanding wall 10*a*, serving to prevent the articles from slipping off the tray bottom wall 11. Side 11*d* of the tray bottom wall 11 is not circumscribed by an upstanding wall 12, but rather receives a resilient pad 13 of substantially the same height as the upstanding wall 12 to provide a flush appearance therewith. Resilient pad 13 is removably atached to side 11*d* of the tray bottom wall 11 by means of end projections 13*a*, 13*b* removably received within recesses 11*e*, 11*f*, formed at the ends of the tray side 11*d*.

As shown particularly in FIG. 3, the side 13*c* of the resilient pad 13 is of curved configuration to conform to the curvature of the person's body when the device is supported by the person's body as shown in FIG. 1. Resilient pad 13 may be made of any suitable material, such as sponge plastic covered by an outer layer of plastic sheet material, leather, or the like.

The upstanding wall 12 is further formed with outward curved projections 14, 15 at the opposed sides of the tray. These projections serve as handles for manually gripping the tray whenever it may be desired to support the tray manually.

Tray 10 further carries a rotatable knob 16 at one side which is used for adjustably securing the supporting arm 20 to it.

The supporting arm 20 includes a first section 21 attached to the tray 10, and a second section 22 attached to the crossbar 30. As seen particularly in FIG. 2, section 21 extends longitudinally of the tray 10 but gradually curves downwardly, when the device is supported by the person's body as shown in FIG. 1; whereas section 22 of the supporting arm extends vertically upwardly such that the crossbar 30 at the end of arm section 22 is above the tray 10 when the device is supported by the person's body.

Section 21 of the supporting arm 20 is further formed with an elongated slot 23 for receiving knob 16 of the tray. Knob 16 may thus be loosened in order to adjust the position of the tray 10 with respect to the crossbar 30, and then tightened within slot 23 in order to fix the tray in the adjusted position.

Section 21 of supporting arm 20 may be formed with another elongated slot 24 for substantially its complete length. Slot 24 increases the flexibility of section 21 of the supporting arm 20, and also reduces the weight and material required for the device. Section 22 of the supporting arm 20 is integrally formed with the crossbar 30.

When the device is worn by a person, the front side of the tray carrying the resilient pad 13 engages the front side of the person's body at about the waistline; and crossbar 30 engages the lower part of the back of the person's body at a level above the level of the tray 10, so that the weight on the tray tends to pivot the crossbar 30 against the person's back. Crossbar 30 is also provided with a resilient pad 31, in the form of a sleeve received on the crossbar. As shown particularly in FIG. 3, the end 32 of crossbar 30, and also of its resilient pad 31, is curved towards the tray 10, but leaves enough space between it and resilient pad 13 carried at the respective side of the tray, to permit a person to conveniently apply the device from the side to the person's body.

The manner of using the device illustrated in the drawings will be apparent from the above description. Thus, to apply the device to the person's body, the device may be gripped with one hand and crossbar 30 moved slightly away from the tray 10 (this being permitted by the flexibility of arm section 21) sufficient to permit applying the tray via space SP to the person's body. When the device is so applied, the device is supported soley by the person's body, as shown in FIG. 1, thereby leaving the person's hands free for other uses, such as for gripping the crutches 4. In addition, the device may be conveniently applied with one hand from the side of the person's body, and produces substantially no interference with hand and shoulder movements.

The illustrated device may be used as a simple tray by merely detaching the tray section 10 from the supporting arm 20 by removing fastener 16. If desired, resilient pad 13 may also be removed by slipping its end projections 13*a*, 13*b* from the recessed corners 11*e*, 11*f* of the tray bottom wall 11.

While the invention has been described with respect to one preferred embodiment, it will be appreciated that many variations, modifications and other applications of the invention may be made.

What is claimed is:

1. An article supporting device including a tray having mounting means for mounting the tray on the body of a person with a side of the tray engageable with the front side of the person's body at about the waistline; characterized in that said mounting means comprises:

a crossbar having one end secured to the tray and the opposite end spaced from the tray to permit the device to be applied from the side to the person's body;

said crossbar being located to engage the lower part of the person's back when the device is mounted on the person's body.

2. The device according to claim 1, wherein said one end of the crossbar is secured to said tray by an arm having a first section adjacent the tray and extending below the tray, and a second section adjacent the crossbar and extending above said first section.

3. The device according to claim 2, wherein said first section of the arm is secured to one end of said side of the tray, and said second section of the arm extends above the tray.

4. The device according to claim 2, wherein said arm is secured to said tray by an adjustable securing means permitting the tray to be adjusted towards or away from said crossbar.

5. The device according to claim 4, wherein said adjustable securing means comprises a fastener carried by the tray receivable in an elongated slot formed in said supporting arm.

6. The device according to claim 1, wherein said tray is formed with handles at its opposite sides.

7. The device according to claim 1, wherein the side of the tray engaging the person's body, when the device is supported by the person's body, includes a resilient pad.

8. The device according to claim 7, wherein said resilient pad includes end projections formed in the resilient pad removably received within recesses formed in the respective side of the tray.

9. The device according to claim 1, wherein the side of said crossbar engaging the person's body, when the device is supported by the person's body, includes a resilient pad.

10. The device according to claim 1, wherein said tray is circumscribed by an upstanding wall along the sides thereof not engaging the person's body when the device is supported by the person's body.

11. The device according to claim 10, wherein said upstanding wall is formed with outward extensions serving as handles at opposite sides thereof.

* * * * *